United States Patent [19]

Cobb

[11] Patent Number: 4,820,382

[45] Date of Patent: Apr. 11, 1989

[54] METHOD AND APPARATUS FOR REMOVING SOLIDS FROM AN UPWARDLY MOVING BED CHAMBER

[75] Inventor: Delwin E. Cobb, Peoria, Ill.

[73] Assignee: Union Oil Company of California, Los Angeles, Calif.

[21] Appl. No.: 180,624

[22] Filed: Apr. 11, 1988

Related U.S. Application Data

[63] Continuation of Ser. No. 712,552, Mar. 15, 1985, abandoned.

[51] Int. Cl.[4] ..... C10B 1/04; C10B 49/06; C10B 53/06

[52] U.S. Cl. ..... 201/32; 48/87; 202/99; 202/262; 208/400; 414/209

[58] Field of Search ..... 202/93, 95, 99, 215, 202/222, 251, 262, 265; 48/85.2, 86 R, 87; 414/209, 301, 302, 588; 422/225; 366/195, 196; 201/32, 33, 40; 208/400

[56] References Cited

U.S. PATENT DOCUMENTS

| | | | |
|---|---|---|---|
| 599,264 | 2/1898 | Smith | 202/103 |
| 1,166,175 | 12/1915 | Bishop | 202/265 |
| 1,793,838 | 2/1931 | Can et al. | 201/33 |
| 1,910,238 | 5/1933 | Can et al. | 202/215 |
| 2,640,019 | 5/1953 | Berg | 202/95 |
| 2,700,644 | 6/1955 | Leffer | 202/91 |
| 2,881,117 | 4/1959 | Berg et al. | 202/95 |
| 2,895,887 | 7/1959 | Deering et al. | 202/222 |
| 2,954,328 | 9/1960 | Deering et al. | 201/32 |
| 2,954,329 | 9/1960 | Dhondt et al. | 202/93 |
| 2,980,592 | 4/1961 | Deering et al. | 201/32 |
| 3,763,013 | 10/1973 | Allred | 202/103 |
| 4,029,220 | 6/1977 | Greaves | 414/588 |
| 4,098,586 | 7/1978 | Woodmansee | 48/85.2 |
| 4,162,960 | 7/1979 | Dhondt | 208/11 R |
| 4,210,491 | 7/1980 | Schulman | 201/2.5 |
| 4,243,510 | 1/1981 | Dhondt | 208/11 R |
| 4,445,910 | 5/1984 | Zimmerman | 48/86 R |

*Primary Examiner*—Kenneth M. Schor
*Assistant Examiner*—Joye L. Woodard
*Attorney, Agent, or Firm*—H. R. Lambert; G. F. Wirzbicki

[57] ABSTRACT

A method for forming a terraced structure in the upper surface of a particulate solid bed, typically oil shale, moving upward through an upflow retort and removing particulate solids from the upper surface, which includes rotating a scraping means comprising a shaft having a plurality of scrapers secured thereto arranged in a vertically spaced-apart relationship and in a radially outwardly-stepped relationship relative to a vertical axis of the shaft.

17 Claims, 5 Drawing Sheets

METHOD AND APPARATUS FOR REMOVING SOLIDS FROM AN UPWARDLY MOVING BED CHAMBER

This application is a continuation, of application Ser. No. 06/712,552, filed Mar. 15, 1985, now abandoned.

BACKGROUND OF THE INVENTION

The present invention relates to an apparatus useful in the production of hydrocarbon gases and oils from hydrocarbonaceous solids by the thermal pyrolysis of the solids. Specifically, the present invention is an apparatus for the removal of spent solids, ash and fine materials from an upflow bed of particulate oil shale rock undergoing thermal pyrolysis in a retort.

Vast deposits of oil shale, a sedimentary inorganic rock containing about 35 weight-percent calcite ($CaCO_3$), 15 weight-percent dolomite ($MgCO_3 \cdot CaCO_3$), and 10 weight percent alkali metal salts are known to exist in the United States, especially in the Green River formation in Colorado, Utah, and Wyoming. The oil shale in these deposits contains between 5 and 35 weight-percent of hydrocarbons in a form known as kerogen. When pyrolized, this kerogen decomposes to produce crude shale oil vapors, which, upon condensation, become a valuable source of fuel.

Several pyrolytic processes have been developed to produce crude shale oil from oil shale rock, e.g., those disclosed in U.S. Pat. Nos. 3,361,644; 4,069,132; 4,162,960; and 4,243,510, all of which are incorporated herein by reference. In a typical process, particulate oil shale rock is fed upwardly through a vertical retort by means of a reciprocating piston. The upwardly moving oil shale rock continuously exchanges heat with a downwardly flowing high-specific-heat, hydrocarbonaceous recycle gas introduced into the top of the retort at about 1200° F. In the upper section of the retort (the pyrolysis zone), the hot recycle gas educes hydrogen and hydrocarbonaceous vapors from the oil shale rock. In the lower section (the preheating zone), the oil shale rock is preheated to pyrolysis temperatures by exchanging heat with the mixture of recycle gas and educed hydrocarbonaceous vapors plus hydrogen. That portion of the retorting apparatus wherein this heat exchange and pyrolysis takes place is generally referred to as a kiln. Most of the heavier hydrocarbons condense in the lower section and are collected at the bottom of the retort as a product oil. The uncondensed gas is then passed through external condensing or demisting means to obtain more product oil. The remaining gases are then recovered as a product gas, some of which is used as the recycle gas discussed previously, and some is combusted to heat the recycle gas to the hereinbefore specified temperature of 1200° F., with the remainder being a source of fuel for any other purpose.

As the oil shale moves upward, it eventually reaches the top of the kiln and the retorted material, e.g. spent solids, ash and fine materials spill over onto a chute leading to a combustor, a steam stripping chamber, or a sealing chamber leading to an ash disposal area. Although gravity causes some of the retorted material to spill onto the chute, the amount that spills onto the chute over a specific amount of time is insufficient for most commercial retorting operations. Thus it is desirable to increase the rate at which the material spills over the kiln onto the chute. Numerous devices have been suggested for scrapping the spent shale, ash and fine materials from the top of an upflow bed of oil shale rock. These devices typically comprise various blade arrangements, such as those in U.S. Pat. Nos. 2,980,592; 2,954,328; and 2,895,887 all issued to Deering et al. and 2,954,329 issued to Dhondt et al.

Previously used blade scraping apparatus encountered difficulty in removing the spent shale, ash and fine materials due to the pressure exerted by the high-specific-heat, hydrocarbonaceous recycle gas. The downward flowing gas compacts the upflowing particulate materials, which in turn increases the torque needed to move a scraping apparatus through the upflowing material. As the blades of a scraping apparatus move through the upflow moving material, the material breaks up into smaller and smaller particles until fine materials accumulate at the upper surface in such amounts that a dramatic pressure drop of the downwardly-flowing, high-specific-heat, hydrocarbonaceous recycle gas is observed across this region. This results in less of the gas penetrating downward through the upflow particulate material, which in turn causes a reduction in the efficiency of the retort. Also it has been observed that fine materials compact tighter than larger particulate materials, further raising the torque requirement of the scraping devices. As the torque requirement increases the fine materials production increases, causing a contiuous cycle of fines production and torque increase until eventually the stress tolerance of the apparatus is reached, leading to a shutdown of the retort. Furthermore, the efficiency of the retort is significantly impaired due to the accumulation of fine materials.

It can be seen that there is a need for an apparatus capable of scraping off the upper portion of a particulate bed of solids (e.g., oil shale rock) moving upwardly in a retort while maintaining low torque requirements and minimizing the production of fine materials.

SUMMARY OF THE PRESENT INVENTION

The present invention is an apparatus and process for removing the surface of a particulate solids mass, such as a particulate oil shale, as the mass moves in a generally upward direction in a retort. The apparatus of the present invention, by means of a plurality of cutting edges revolving about the same vertical axis, but disposed in different horizontal planes, forms in the surface of the upflowing solids mass a plurality of generally planar, concentric, ring-like terraces. Each terrace lies in a different horizontal plane, normal to the axis, with the diameter of any one terrace larger than the terrace directly above it and smaller than the terrace directly below it.

BRIEF DESCRIPTION OF THE DRAWINGS

The present invention may be better understood and its numerous advantages will be apparent to those of ordinary skill in the art by reference to the accompanying drawings, wherein like reference numerals refer to like elements in the several figures, in which.

DESCRIPTION OF THE PREFERRED EMBODIMENTS

Figure 1:
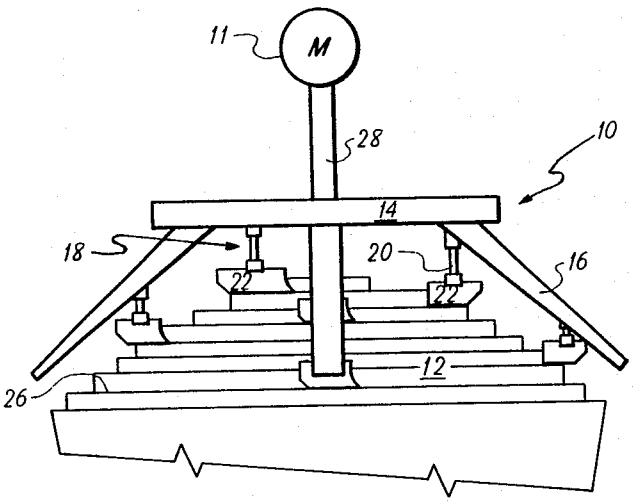
FIG. 1 is a side view of a scraping apparatus in accordance with one embodiment of the present invention shown forming a terraced solids pile.

Referring to FIG. 1, scraper apparatus 10, in accordance with one embodiment of the invention, is shown in position above and in contact with, solids pile 12 having formed in its uppermost surface a terraced structure by the rotation of apparatus 10 about its vertical axis, defined by shaft 28. Although solids pile 12 may be comprised of any particulate solid material, including non-hydrocarbon bearing particulate material, pile 12 is generally comprised of hydrocarbon bearing particulate material, e.g. coal. Preferably, solids pile 12 is comprised of particulate oil shale rock.

The uppermost portion of the particulate oil shale rock mass, shown in FIG. 1, is moving upwardly through a conventional upflow retort. This uppermost portion of pile 12 is the particulate oil shale after undergoing pyrolysis and is thus comprised of spent shale, ash and fine materials.

Conventional retorts are known to those skilled in the art. Typical upflow retorts are disclosed in U.S. Pat. Nos. 2,881,117; 2,895,887; 2,954,328; 2,954,329; and 2,980,592, all of which are incorporated herein by reference in their entireties. In conventional upflow retorts, pile 12 is fed upward, typically by a reciprocating piston or feed screw. The incorporated references illustrate various types of retorts in which the scraper apparatus of the invention could be used; however, the apparatus of this invention could be used in any other upflow type retort.

Scraper apparatus 10 would typically be affixed within a conventional retort in a location wherein it may be conveniently employed to scrape uppermost surface of pile 12 onto a chute or other device for removing the material comprising pile 12 from the retort. The scraper apparatus 10 would normal be within the retort except for a motor 11 and associated gears or pulleys, which would typically be positioned outside of the retort but in some manner connected to shaft 28, used to rotate the apparatus 10. Motor 11 may be any conventionally powered engine or other device useful for rotating apparatus 10 and has not been shown in detail since the type of device is not critical to the invention. Furthermore, no other portion of the retort or means for suspending apparatus 10 within the retort has been shown since these are not critical to the invention. Any suitable means for supporting apparatus 10 in a retort is within the scope of the invention.

Scraper assembly 10 is comprised of a support platform 14 to which arms 16 are attached at an outward and downward angle, such that arms 16 are at an angle from the platform 14 greater than 90° and are positioned axisymmetric. Attached to the undersides of platform 14 and arms 16 in a generally vertical position are blade assemblies 18. Each blade assembly 18 comprises support post 20 which is connected at one end to platform 14 or arm 16 and at the other end to substantially vertically oriented blade 22.

The scraper assembly 10 is positioned above the upwardly moving solids pile 12 within a conventional retort. Flowing downward past scraper apparatus 10 into pile 12 is the high-specific-heat recycle gas used in the pyrolysis of the hydrocarbon-containing solids, specifically the particulate oil shale rock. As the solids pile 12 moves upward through the retort, its upper surface is brought into contact with the lowermost edge of each blade 22 rotating about the vertical axis defined by shaft 28, as better seen in FIGS. 5A and 5B. This lowermost edge of blade 22 is cutting edge 24. Blade assemblies 18 are attached to the platform 14 and arms 16 so that the respective cutting edges 24 lie within different planes horizontal to the vertical axis of scraper assembly 10. As apparatus 10 rotates, the cutting edges 24 cut through upper surface of pile 12 forming the terrace structure shown. This terrace structure comprises generally horizontal concentric, ring-like ledges 26 that lie within the same horizontal plane as the respective cutting edge 24, which formed it. The particulate material of pile 12, cut away by the action of rotating blades 22, drops from one ledge 26 to the next lower ledge 26 until the material completely drops off the pile 12, typically falling onto a chute, not shown. The blades 22 are further arranged, so that cutting edges 24 form the concentric ledges 26 with diameters increasing in a descending order. Thus, each ledge 26 will have a diameter greater than the ledge 26 directly above it but less than the ledge 26 directly below it.

While the embodiment of the invention shown in FIG. 1 illustrates the invention with blade assemblies attached to the underside of platform 14 and arms 16, other configurations that allow cutting edges 24 to form generally planar concentric ledges 26 in the upper pile surface 15 in the manner described above is within the scope of the invention. Other types of suitable arrangements could have one single arm possessing, for example, four blades 22. It may also be suitable to use any number of arms 16, with four blades 22 usually being provided and with at least eight blades 22 being preferred, and from eight to twelve blades 22 most preferred. Furthermore, it is preferable when providing more than one arm 16, that they be positioned axisymmetric.

Figure 2:
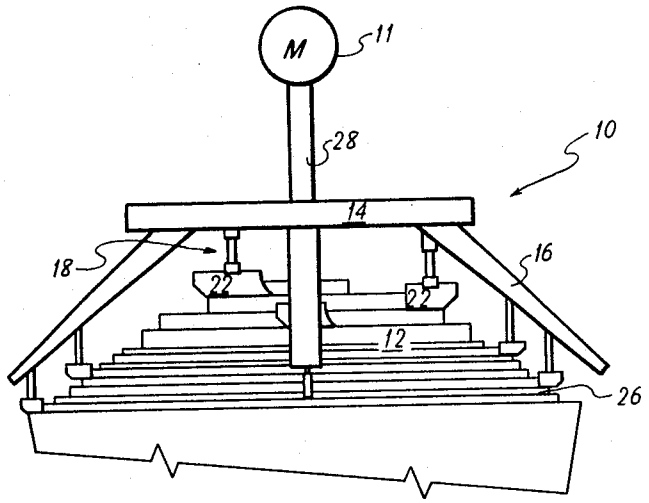
FIG. 2 is a side view of another embodiment of a scraping apparatus in accordance with the present invention.

Referring now to FIG. 2, another embodiment of the invention is seen comprising twelve blade assemblies 18, having the corresponding number of blades 22. As the number of blades 22 increases or decreases, the actual length of the blade 22 varies, with the total length of the sweep of all of blades 22 generally being equal to the radius of pile 12.

The scraper apparatus 10 of this invention, by forming a terraced structure in upper surface of pile 12, requires less torque and produces less fines than previous apparatus, as exemplified by the device disclosed in U.S. Pat. No. 2,954,329, used to remove the uppermost surface of an upwardly moving particulate material mass through which a high-specific-heat recycle gas flows downward. This terraced structure further increases the surface area of pile 12, allowing more of the recycle gas to pass into the pile 12 and carry out the desired pyrolysis in the lower portion of the moving mass.

Figure 5A:
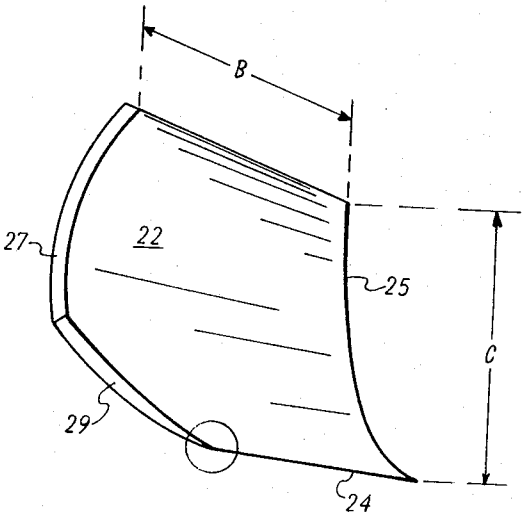
FIG. 5A is an isometric view of a scraper blade in accordance with a preferred embodiment of the invention.
Figure 5B:
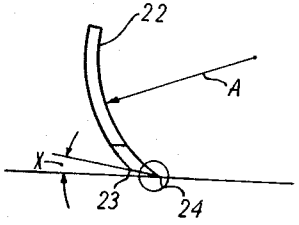
FIG. 5B is a side view of the blade of FIG. 5A.

Blade 22 may have any number of sides or be any shape, such as flat and/or quadrangle, but as shown in FIGS. 5A and 5B, blade 22, which is quadrangle, preferably is curved, with the curvature equal to that of an arc of a circle, preferably a circle having a radius of from about 14 to about 20 inches, more preferably about 16 inches, as shown by line A, with an overall width, as shown by line B, from 2.5 to 4.5 feet, and a height, as shown by line C, of from 15 to 22 inches. Blade 22 is preferably one continuous piece, with cutting edge 24 the lowermost end. It is preferable to harden blade 22 at cutting edge 24, such as by depositing hardening material at the lowermost surface of blade 22 along cutting edge 24. This hardening material may be in the form of solder containing tungsten-carbide particles. It is also suitable to utilize a blade 22 comprised of more than one piece, with the cutting edge 24 provided by a first portion fastened, such as by bolts, to a second portion forming the remainder of blade 22. This allows for the replacement of cutting edge 24 without changing entire blade 22. Blade 22 may be prepared from any suitably strengthened material, e.g., stainless steel. Cutting edge 24 may be of any configuration, e.g., as a straight flat edge, but preferably cutting edge 24 has a knife edge with a rear surface, either in the form of a straight or curved edge, upwardly angled away from the direction of rotation, as best seen in FIG. 5B at reference point 23, to allow the particulate material of pile 12 to pass behind blade 22 with less resistance. This angling of the rear lower surface 23 shall for this invention be known as the "relief angle" and shall be determined by taking the angle X between surface 23 and the plane in which the ledge 26 being formed lies. This relief angle X should be sufficient enough to allow flow of the material behind the blade, preferably at least 6°, and more preferably 6° to 10°.

It has been found that torque can further be reduced by providing a specific angular relationship between each cutting edge 24 and the upper surface of pile 12. This angular relationship shall be referred to as the "angle of attack" of the cutting edge 24. For the purposes of this invention, the "angle of attack" shall mean the angle (see FIG. 3B) between a first line W drawn through the axis of rotation of the apparatus 10, as defined by shaft 28, and a point D defining that end of cutting edge 24 closest to the axis of rotation, and a second line Y drawn through point D and a second point E defining the opposite end of cutting edge 24. In this invention point D will be the leading point and point E will be the trailing point because point D will always precede point E about the direction of rotation of apparatus 10. Generally, the angle of attack is greater than 0° and less than about 90°, with the preferred angle of attack being from about 25° to about 60°, and more preferably from about 35° to about 45°. The angle of attack positions the cutting edge 24 such that, as it moves through the particulate material comprising pile 12, the material being cut is swept from the leading point D, back across the blade 22, past the trailing point E, dropping to the next lower ledge 26.

Figure 3A:
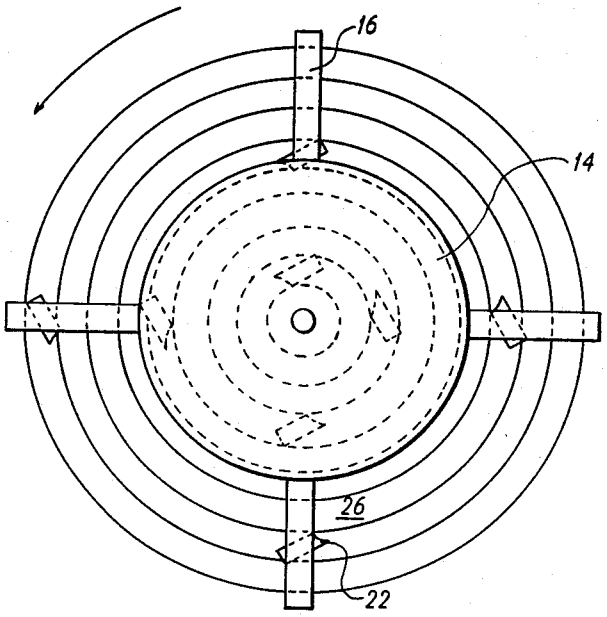
FIG. 3A is a top view of the scraper assembly of FIG. 1.
Figure 3B:
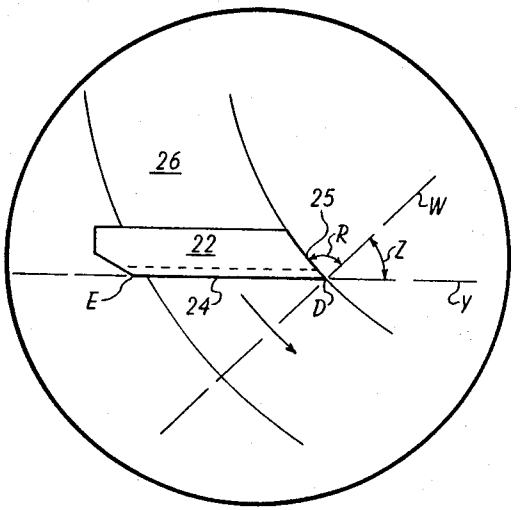
FIG. 3B is an enlarged view of a blade positioned across a terrace in accordance with a preferred embodiment of this invention.

Although blade 22 may, as stated above, have any desired shape, e.g., quadrangle, the preferred blade 22 is shown in FIGS. 5A and 5B is provided with a side 25, the side closest the axis of rotation, that is sloped upwardly and inwardly from cutting edge 24. The degree at which side 25 slopes is dependent upon the angle of attack of blade 22 with side 25 preferably being straight. Generally, as best seen in FIG. 3B, side 25 is angled such that it falls within a first vertical plane through point D which is at an angle R to a second vertical plane radiating from the axis of rotation through point D and which encompasses line W. This angle R may be from 80° to 110°, more preferably 90°. Furthermore, it is preferable to provide the edge of side 25 with a relief angle as discussed above for cutting edge 24.

In order to provide efficient disposition of the material being cut from pile 12 by blades 22, it is preferable to extend the length, line B of FIG. 5A, so that some of blade 22 extends out over the next lower ledge 26 being formed. This allows the material being cut to roll across the face of blade 22 and drop onto the next lowermost ledge 26. It would also be suitable to cut the blade 22 from its outermost, from the axis of rotation, side 27 down across to that portion of cutting edge 24 no longer in contact with the ledge 26 being formed, thus forming cutoff 29. This reduces the amount of material necessary in manufacturing each blade 22.

It is further preferable to provide that the depth at which the blade 22 cuts into the particulate material comprising the upper surface 15 of solids pile 12 be from about ⅝ inches to about 2 inches, more preferably about 1½ inches. This lowers the resistance of moving blade 22 through the material comprising solids pile 12, reducing torque and fines formation. The depth of cut is dependent upon rotation per unit time of apparatus 10 and the rate pile 12 moves upward through the retort. Thus, as the rate of rotation increases the depth of cut is reduced, while increasing the rate of upward movement without increasing the rate of rotation increases the depth of cut.

Figure 6:
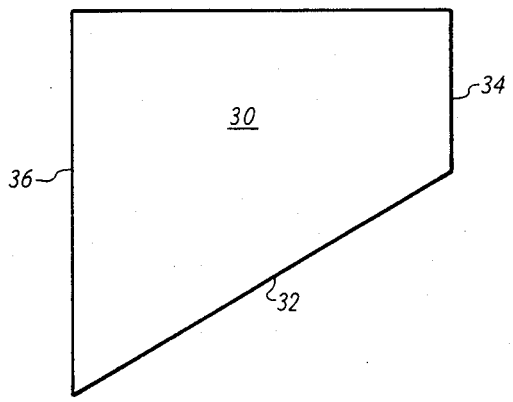
FIG. 6 is a front view of a top flat plate in accordance with a preferred embodiment of this invention.

It should be noted that while it is suitable to use a blade 22 to form a terrace in the top of pile 12, thus providing pile 12 with a flat top surface, the benefit derived from the "angle of attack" is lost since innermost side 25 would be positioned at about the axis of rotation. It is thus preferable to provide another means for cutting or pushing the material at the top of pile 12 onto the first terrace or ledge 26 being formed. One particularly preferred means, as shown in FIG. 6, is a flat plate 30. Plate 30 is positioned within a vertical radial plane from the axis of rotation and has its lowermost end 32 angled downward from inner side 34, closest to axis of rotation, to outermost side 36. Inner side 34 is positioned near shaft 28 and preferably immediately adjacent shaft 28 which represents the vertical axis of apparatus 10. Preferably, lowermost end 32 is a cutting edge with a "relief angle" as discussed above. Thus, as flat blade 30 is rotated it forms a cone in the top of pile 12, pushing or cutting the material as it moves upward through the retort onto the first forming ledge 26.

Other means of pushing or cutting the top of pile 12 would be within the scope of this invention, such as an inverted cone that is driven into the material through the upward movement of pile 12. By positioning this inverted cone above the uppermost of blades 22 the material is pushed outward onto the uppermost forming ledge 26.

Figure 4:
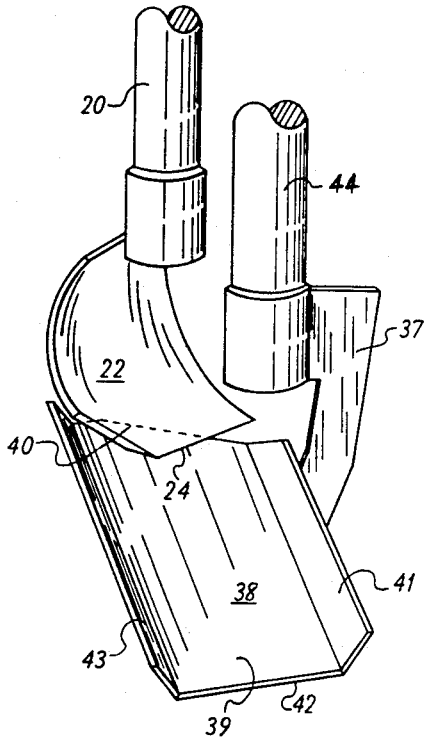
FIG. 4 is an isometric view of a scraper blade and chute assembly in accordance with a preferred embodiment of the present invention.

Referring to FIG. 4, in accordance with one preferred embodiment of the present invention, the apparatus 10 is further provided with chutes 38 comprised of a bottom plate or planar surface 39 and sides 41 and 43 angled outwardly from said plate at an angle greater than 90°. The chutes are positioned with respect to blades 22 so that the material being cut is deposited onto bottom plate 39 and through gravity travels down across the bottom of plate 39 onto the next lower ledge 26 or completely off pile 12. Each chute 38 is secured in place to an arm 16, typically the same arm 16 (in FIGS. 1 and 2) that the respective blade 22 is secured to; the chutes may be secured by a post 44 and bracket 37 arrangement. Chute 38 has a first end 40 which is positioned beneath cutting edge 24 of blade 22 at a sufficient enough distance, typically 0.5 to 4 inches, to allow material being cut by edge 24 to drop onto chute 38 without being caught between the cutting edge 24 and the chute 38. Chute 38 is positioned angularly downward from first end 40 sufficient enough to allow the material to travel across the bottom plate 39 of chute 38 by gravity. Preferably the bottom plate 39 of chute 38 forms an angle from the horizontal of at least 30°, more preferably 30° to 45°. While it is feasible to put chutes 38 under each blade 22, it is more preferable to use a chute 38 only with each of the next to lowermost blades 22, such as the four next to lowest blades 22 of the embodiment shown in FIGS. 1 and 3 and the six next to lowermost blades 22 of the embodiment shown in FIG. 2. While it is permissible to use a chute 38 with the lowermost blade 22, it is not essential since the particulates being cut by that blade 22 drop off pile 12 directly.

Chute 38 is positioned generally beneath cutting edge 24 of blade 22, such that first and second ends 40 and 42 of chute 38, respectively, are essentially parallel to each other and perpendicular to different radial vectors from the vertical axis through said ends 40 and 42. In a preferred embodiment, sides 40 and 42 of chute 38 are not parallel, but remain perpendicular to radial vectors, and as shown in FIG. 4, side 40 slopes upwardly from side 41 to side 43. Furthermore, first end 40 is provided with a cutting edge and "relief angle" to allow it to cut the material comprising pile 12.

While the preferred embodiments have been described and illustrated, various modifications and substitutions may be made thereto without departing from the scope of the invention. Accordingly, it is to be understood that the present invention has been described by way of illustration and not limitation.

I claim:

1. A method for removing particulate matter from an exposed upper surface of a body of particulate matter being transported upwardly through a chamber, the method comprising the steps of:

(a) arranging a plurality of scraper blades in a vertically-stepped relationship and in a radially outwardly-stepped relationship relative to a vertical axis;

(b) mounting the arrangement of scrapper blades in the path of said exposed upper surface of the particulate matter body as the particulate matter is transported upwardly through the chamber; and (c) rotating, about the vertical axis, the arrangement of scraper blades and forming a plurality of vertically-and radially outwardly stepped annular terraces in said exposed upper surface of the particulate matter body as said body is transported upwardly through the chamber and thereby removing particulate matter from the exposed upper surface of the body of particulate matter by the scraping action of the rotating scraper blades spilling particulate matter from each one of the plurality of annular terraces.

2. The method as claimed in claim 1, including the step of diverting the flow of scraped particulate matter spilling from at least one of the terraces.

3. The method as claimed in claim 1, including positioning a central blade above the arrangement of scraper blades and rotating the central blade therewith for scraping particulate matter on top of the exposed surface of the particulate matter body and spilling the scraped particulate matter onto the uppermost one of said terraces.

4. The method as claimed in claim 1, wherein said plurality of terraces comprise at least about four of said terraces.

5. The method as claimed in claim 1, wherein the body of particulate matter comprises oil shale being transported upwardly through a retort chamber in which oil is extracted from the oil shale by a counterflow of hot, pressurized gas flowing downwardly through the upwardly moving body of oil shale.

6. In combination with a chamber through which a body of particulate matter is transported upwardly, apparatus for removing particulate matter from an exposed upper surface of said particulate matter body, the apparatus comprising:

(a) scraping means for scraping particulate matter from the upper surface of the particulate matter body, said scraping means including a shaft having a vertical axis and a plurality of scrapers secured to said shaft and arranged in a vertically spaced-apart relationship and in a radially outwardly-stepped relationship relative to the vertical axis of said shaft;

(b) means for rotatably mounting said shaft about the vertical axis; and (c) means for causing rotation of the shaft, wherein rotation of the scraping means will form a plurality of vertically-and radially outwardly-stepped annular terraces in the exposed upper surface of the body of particulate matter as it is transported upwardly through the chamber and thereby removing particulate matter from the exposed upper surface of the body by the scraping action of the rotating scrapers spilling particulate matter from each one of the plurality of annular terraces.

7. The apparatus as claimed in claim 6, wherein each scraper plurality of scrapers comprises a scraper blade having a lower scraping edge which is positioned so as to be substantially orthogonal to the vertical axis of said shaft.

8. The apparatus as claimed in claim 6, wherein each scraper of the plurality of scrapers comprises a scraping blade having a lower scraping edge positioned so as to have an angle of attack between about 0° and about 90° relative to blade rotational direction of travel.

9. The apparatus as claimed in claim 8, wherein the angle of attack is between about 25° and about 60°.

10. The apparatus as claimed in claim 8, wherein the lower scraping edge of the blade of each said scraper has a rearward relief angle of at least about 6°.

11. The apparatus as claimed in claim 6, wherein each scraper of the plurality of scrapers comprises a scraping blade which is convave in the rotational direction of blade travel.

12. The apparatus as claimed in claim 11, wherein the concave scraping blade of each scraper has a radius of curvuature between about 14 inches and about 20 inches.

13. The apparatus as claimed in claim 6, wherein said scraping means further includes means for causing particulate matter on top of the exposed upper surface secured to said shaft above the arrangement of scrapers of the particulate matter body to fall upon the uppermost one of the terraces in response to rotation of the scraping means and in response to the transporting of the body of particulate matter upwardly through the chamber.

14. The apparatus as claimed in claim 13, wherein said means for causing particulate matter on the top of the exposed upper surface of the particulate matter body to fall upon the uppermost one of the terraces comprises a central blade having a lower scraping edge for cutting a cone-shaped surface on the top of the exposed upper surface.

15. The apparatus as claimed in claim 6, including means secured to at least one of said plurality of scrapers for receiving and diverting the flow of particulate matter spilling from the terrace formed by the at least one scraper and removing the diverted flow from the exposed upper surface of the body of particulate matter or transferring the diverted flow to a lower terrace.

16. The apparatus as claimed in claim 15, wherein the means for receiving and diverting the flow of spilling particulate matter comprises an inclined chute secured to an outer end region of the at least one scraper.

17. The apparatus as claimed in claim 6, wherein said plurality of scrapers comprises about 4 to about 12 scrapers arranged between about 4 and about 12 of the terraces.

* * * * *